US007931854B2

(12) United States Patent
Syropyatov

(10) Patent No.: US 7,931,854 B2
(45) Date of Patent: Apr. 26, 2011

(54) UNIT FOR CATALYTIC GAS NITROGENATION OF STEELS AND ALLOYS

(75) Inventor: Vladimir Yakovlevich Syropyatov, Solnechnogorsk (RU)

(73) Assignee: Obshchestvo S Ogranichennoi Otvetstvennoystyu 'Solnechnogorsky Zavod Termicheskogo Oborudovania 'Nakal', Solnechnogorsk (RU)

( * ) Notice: Subject to any disclaimer, the term of this patent is extended or adjusted under 35 U.S.C. 154(b) by 0 days.

(21) Appl. No.: 12/535,354

(22) Filed: Aug. 4, 2009

(65) Prior Publication Data

US 2009/0289398 A1 Nov. 26, 2009

Related U.S. Application Data

(63) Continuation of application No. PCT/RU2007/000079, filed on Feb. 19, 2007.

(30) Foreign Application Priority Data

Nov. 24, 2006 (RU) ..... 2006141494

(51) Int. Cl.
*C21B 7/24* (2006.01)

(52) U.S. Cl. ..... 266/99; 266/252

(58) Field of Classification Search ..... 266/78, 266/99, 252

See application file for complete search history.

(56) References Cited

U.S. PATENT DOCUMENTS

| | | | | |
|---|---|---|---|---|
| 2,541,857 | A * | 2/1951 | Besselman et al. | 266/80 |
| 5,865,908 | A | 2/1999 | Takei et al. | |

FOREIGN PATENT DOCUMENTS

| | | |
|---|---|---|
| RU | 1786413 | 1/1993 |
| RU | 2061088 | 5/1996 |
| RU | 2109080 | 4/1998 |
| RU | 35422 | 1/2004 |
| RU | 2230824 | 6/2004 |

* cited by examiner

*Primary Examiner* — Scott Kastler

(74) *Attorney, Agent, or Firm* — Notaro, Michalos & Zaccaria P.C.

(57) ABSTRACT

Equipment for thermochemical treatment of steels and alloys in gaseous mediums with automatic control includes a heating furnace with/without a muffle, a process gas catalyst impact block located in the furnace, a mechanism for supply, mixing, proportioning and extraction of process gases and a device of indirect monitoring and control of the nitrogen potential in the furnace atmosphere. The device of indirect monitoring and control of the nitrogen potential in the furnace atmosphere is an oxygen sensor, a secondary transducer with indication of the nitrogen potential in weight units of nitrogen content in iron and an actuator, while the process gas catalyst impact block is located in the furnace on the process gas supply line. The technical result achieved is that reliability and stability of processes are significantly increased, as well as the period of nitriding is reduced due to integrated process automation that is available.

10 Claims, 1 Drawing Sheet

UNIT FOR CATALYTIC GAS NITROGENATION OF STEELS AND ALLOYS

CROSS REFERENCE TO RELATED APPLICATION

This is a continuation of International patent application PCT/RU2007/000079 filed Feb. 19, 2007 which is incorporated here by reference and which claims priority on Russian patent application RU2006141494 filed Nov. 24, 2006, which priority claim is repeat here.

FIELD AND BACKGROUND OF THE INVENTION

The invention refers to equipment for thermochemical treatment of steels and alloys in gaseous mediums with automatic control.

A nitriding unit for steels and alloys in catalyst-treated ammonia is known that comprises an electric furnace with/without a muffle, an ammonia tank, a gas supply and extraction main line, devices of mixing and proportioning, while a catalyst tank is installed on the gas supply main line to the electric furnace. However it does not include means of indirect process monitoring of iron saturation with nitrogen from the gaseous phase (RF Patent No. 2109080 International Patent Classification C23C8/24 published 20 Apr. 1998).

Means of indirect monitoring of the gaseous phase are known to be used in gas nitriding, ferritic nitrocarburizing and catalytic gas nitriding. However in these means the nitrogen potential is considered to be a ratio of ammonia and hydrogen partial pressures in the furnace atmosphere that in practice does not provide any information on a real situation of the gas nitriding process (Yu. M. Lakhtin etc. Theory and Process of Nitriding. M., "Metallurgy", 1991, pages 39-55).

Their main disadvantage is use of out-of-date evaluation principles for the gaseous phase in the process of iron diffusion saturation with nitrogen and, consequently, a failure to practically control the process.

A unit for low-temperature gas thermochemical treatment of steels and alloys is known that comprises an electric furnace with a muffle, an ammonia tank, a gas supply and extraction main line, a catalyst tank installed inside the furnace space and a solid electrolytic oxygen sensor of immersion type. A signal of the solid electrolytic sensor and nitrogen content in iron are interrelated. For easy control of the process, the nitrogen potential is proposed to be considered equal to nitrogen concentration in iron when the latter reaches balance with the gaseous phase (Zinchenko V. M. et al. Nitrogen Potential: Current State and Development Concept. M, "Mechanical Engineering", 2003, pages 40-50).

This engineering solution is the most similar analogue and is taken as a prior art for the claimed unit. The main disadvantage of the prior art is lack of equipment for real-time automatic determination of the nitrogen potential by sensor signals. In this case an operator is to measure sensor signals by oxygen and temperature, to define a nitrogen potential value by nomograms and only thereafter to take a decision on process adjustment.

SUMMARY OF THE INVENTION

A problem that is to be solved by this invention is creation of a unit for controllable catalytic gas nitriding of metals and alloys that includes complete means of indirect monitoring of diffusion processes according to content of the gaseous phase by oxygen.

The technical result achieved when this invention is implemented is that reliability and stability of processes is significantly increased, as well as period of nitriding is reduced due to integrated process automation available.

The specified technical result is achieved by the fact that the catalytic gas nitriding unit for steels and alloys comprises a heating furnace with/without a muffle, a process gas catalyst impact block located in the furnace, means of supply, mixing, proportioning and extraction of process gases and a device of indirect monitoring and control of the nitrogen potential in the furnace atmosphere. According to the invention, the device of indirect monitoring and control of the nitrogen potential in the furnace atmosphere is an oxygen sensor, a secondary transducer with indication of the nitrogen potential in weight units of nitrogen content in iron, and an actuator, while the process gas catalyst impact block is located in the furnace on the process gas supply line.

The oxygen sensor is a solid electrolytic voltage sensor or semiconductor resistance sensor and has an independent heat setting system.

The catalyst impact block is a tank with a catalyst that is made from foamed ceramics in the form of tablets.

The heating furnace is equipped with electrical heaters or gas burners.

The secondary transducer is made with the capability to provide a standard output signal proportional to predicted concentration of nitrogen in iron.

The secondary transducer includes an output signal interpreter of the oxygen sensor in the form of phase composition in accordance with binary diagram "Iron-Nitrogen".

The secondary transducer is made with the capability of computer visualization of diffusion processes with graphic representation of phase composition, nitrogen concentration and real-time distribution of diffusion layer microhardness.

DESCRIPTION OF THE PREFERRED EMBODIMENT

Figure 1:
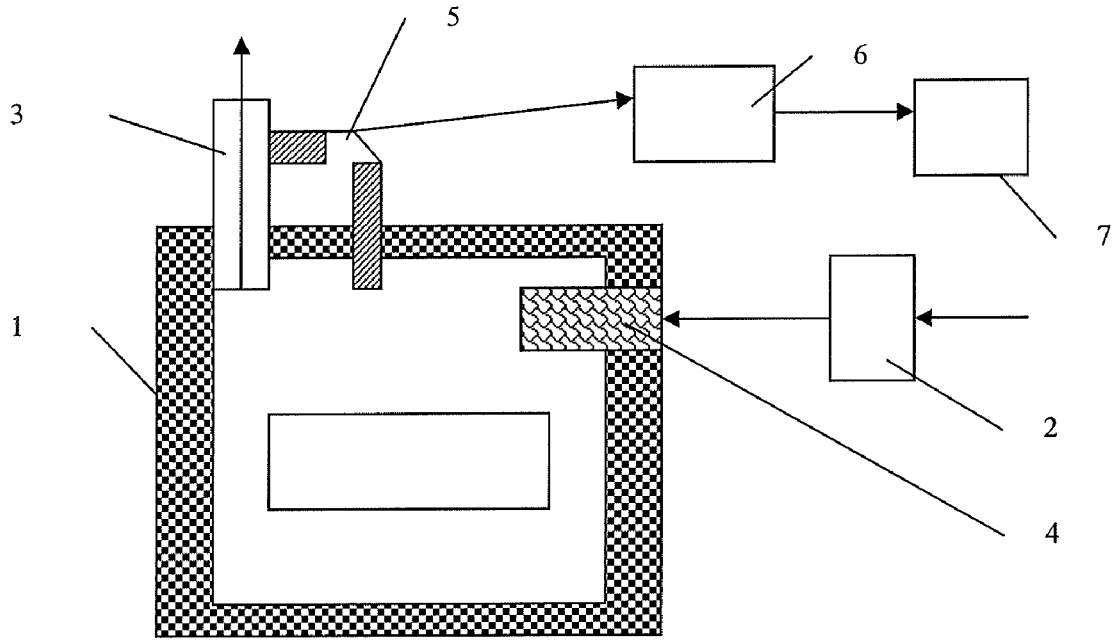
FIG. 1 is a schematic diagram of the apparatus of the invention.

The unit (FIG. 1) comprises the heating furnace 1, with/without the muffle (position is not shown), devices of supply, mixing, proportioning 2 and extraction 3 of process gases supplied from low-pressure networks, block 4 of catalyst impact on the furnace atmosphere located inside the furnace space. The unit is equipped with the device of indirect monitoring and control of the nitrogen potential in the furnace atmosphere made in the form of the oxygen sensor 5, the secondary transducer 6 with indication of the nitrogen potential in weight units of nitrogen content in iron and actuator 7 controlled by an operator or computer.

The nitriding furnace equipped with a catalytic device for ammonia treatment supports the process of iron (steel) saturation with nitrogen under the conditions approximated to the balanced one. However there are a lot of different variables that influence operation of the real furnace that can not be constant: furnace tightness and oxygen inleakage, ammonia quality and content of water and oil in ammonia, surface finish of parts and quantity of oxides on it etc. The indirect monitoring system for the nitrogen potential in the furnace atmosphere is purposed to be used taking into account these variables. In minimum variant only with a secondary transducer of an oxygen sensor with indication of the nitrogen potential, an operator can easily define the current status of diffusion saturation process and activities that are to be made for adjustment to achieve the positive result. The binary diagram "Iron-Nitrogen" is known. When the predicted content of nitrogen on the surface of treated parts is known, an operator can easily assess whether it is much, little or enough. In the variant with computer monitoring automation defines and takes necessary steps—changes flow of process gases, process temperature etc. Equipment that automatically defines the predicted concentration of nitrogen on the surface of treated metal makes it possible to easily simulate the progress of diffusion process in real time by computer and calculate prediction of the result by distribution of nitrogen concentration from surface to metal depth, phase composition of near-surface region and microhardness distribution across the diffusion layer. Therefore, it is possible to rather reliably assess the current result with all variables taken into account and to take the timely decision when it is possible to finish the process with required parameters achieved.

Example. The unit operates as follows.

In industrial muffle furnace of CGN-6.9/7 model with electric heating some cylinders of automatic moulding machines are nitrided. The cylinders are made from 34CrAlMo7 steel and pretreated to get hardness 30 . . . 34 HRC. Technical requirements to parts after nitriding: surface hardness ≧850 HV, thickness of diffusion layer—0.5 . . . 0.8 mm. The parts are pipes with outside diameter of 120 mm, wall thickness of 10 mm and height of 450 mm. Eight parts are charged. At the same time check test pieces made from the same steel with the same pre-treatment are charged. Test piece section—10×10 mm, length—5-50 mm.

Ammonia is supplied to the inside the furnace operating space through an inlet nozzle in a muffle cover from low-pressure shop networks of 3 . . . 5 kPa.

The muffle cover of the furnace had a nozzle with diameter of 22 mm and length of 120 mm at the ammonia supply point. Through the nozzle the catalyst with a carrier from foamed ceramics of aluminium oxide with porosity 70% alloyed with palladium up to concentration 1.0 . . . 1.2% is charged. The catalyst is in the form of tablets with diameter of 18 mm and height of 20 mm. The volume of the charged catalyst is 10 $cm^3$.

For current monitoring of the gaseous phase the furnace is equipped with two oxygen sensors: a solid electrolytic sensor with a sensing element of zirconium dioxide and a semiconductor sensor with a sensing element of titanium dioxide. The sensors are installed through the muffle cover with sensing elements located in the operating space of the muffle. Two sensors are installed to test them in parallel.

For temperature measurement the furnace is equipped with type "K" thermocouple installed in the muffle cover too with coming out of hot junction inside the furnace operating space.

Microprocessor-based temperature controller "Termodat-14" is used as a secondary transducer and program temperature controller.

A programmable microcomputer of DO05DD model "Koyo" is used as a secondary transducer for signals of oxygen sensors to calculate the nitrogen potential by signals of oxygen sensors according to a special equation with the control program for ammonia flow by analog output signal to the actuator-ammonia flow regulator of 1559AX "MKS" model. A nitrogen potential value calculated by the microcomputer is visualized on operator's control panel of OP006DD model, "Koyo". Available ammonia flow is visually controlled by rotameter of RM-0,63 model.

The microcomputer has the following subprograms: for interpretation of a calculated nitrogen potential into the phase composition of the surface layer of treated steel and calculation of diffusion layer growth in real-time of the nitriding process. Subprogram operation results are visualized on the same operator's control panel. An operator uses computer simulation subprograms for diffusion processes to evaluate the process and to take a decision on finishing the nitriding process.

An operator sets on the control panel temperature, nitrogen potential, minimum flow of ammonia, and maximum flow of ammonia. Process parameters: temperature=540° C., minimum flow of ammonia=200 l/h, maximum flow of ammonia=600 l/h, nitrogen potential=5%. When parts are charged, the cover of the muffle is closed and ventilation systems are started, the command "Start" is initiated on the operator's control panel.

During unit operation the controller keeps the specified temperature, the secondary transducer evaluated signals of oxygen sensors, calculated the nitrogen potential, compared it with the specified value and sent a command to the actuator to keep the required ammonia flow. Ammonia flow is kept maximum up to the moment when the nitrogen potential reaches the specified value. When the nitrogen potential reaches the specified value, flow is automatically reduced up to minimum. An operator traces operation of automation and evaluated predicted results of nitriding according to data of a phase composition indicator for the surface zone and diagram of microhardness calculated distribution. In 24 hours of process subprograms of the secondary transducer responsible for simulation of diffusion processes indicates that the specified parameters of surface hardness and thickness of the diffusion layer are reached. Based on the mentioned above, as well as taking into account that there are no failures and faults in equipment operation, an operator takes a decision to finish the process.

Supply of ammonia and heating are switched off by "Stop" command sent from the operator panel. In the manual mode the gaseous nitrogen is supplied to the muffle to release ammonia from the muffle. When muffle temperature reaches 120° C., nitrogen is stopped to be supplied, the muffle is opened and parts are discharged.

Nitriding results are evaluated by check test pieces. Testing results and main parameters of the process in comparison with standard processes, recommended, for example, in reference document Lakhtin Yu. M. et al. Theory and Technology of Nitriding. M., "Metallurgy", 1991, page 39-55, are specified in the Table.

TABLE

| Parameter | Process | Recommended Standard Process |
|---|---|---|
| Temperature, ° C. | 540 | 520 . . . 540 |
| Holding period with specified temperature, h | 24 | 62 |
| Surface hardness, HV | 950 | 800 . . . 1000 |
| Thickness diffusion layer, mm | 0.6 | 0.5 . . . 0.8 |

According to the table data, use of the claimed unit with the monitoring device of the nitrogen potential made it possible to take a timely and reasonable decision to stop the process when the specified parameters of the diffusion layer are reached, that proves process reliability and stability of the claimed unit. The same together with ammonia treatment with the proposed catalyst provided new properties of the furnace atmosphere that results in the possibility to reduce period of nitriding process from 62 up to 24 hours.

What is claimed is:

1. A catalytic gas nitriding unit for steels and alloys comprising:

a heating furnace, said heating furnace having an entry;

a process gas catalyst impact block, means for supply, mixing, proportioning and extraction of process gases; and a device for indirect monitoring and control of the nitrogen potential in the furnace atmosphere, wherein the device of indirect monitoring and control of the nitrogen potential in the furnace atmosphere is an oxygen sensor, a secondary transducer with indication of the nitrogen potential in weight units of nitrogen content in iron and an actuator, said secondary transducer being a programmable microcomputer, said microcomputer having a subprogram for interpretation of a calculated nitrogen potential into a phase composition of a surface layer of treated steel and a subprogram for calculation of growth of a diffusion layer in real-time of the nitriding process; and wherein the process gas catalyst impact block is located on said heating furnace entry on a process gas supply line.

2. The unit according to claim 1, wherein the oxygen sensor is a solid electrolytic voltage sensor.

3. The unit according to claim 1, wherein the oxygen sensor is a semiconductor resistance sensor.

4. The unit according to claim 1, wherein the oxygen sensor has an independent heat setting system.

5. The unit according to claim 1, wherein the catalyst impact block is a tank with catalyst.

6. The unit according to claim 5, wherein the catalyst is foamed ceramics in the form of tablets.

7. The unit according to claim 1, wherein the heating furnace is equipped with electrical heaters or gas burners.

8. The unit according to claim 1, wherein the secondary transducer is made with the capability to generate a standard output signal proportional to predicted concentration of nitrogen in iron.

9. The unit according to claim 1, wherein the secondary transducer has an output signal interpreter of the oxygen sensor in the form of phase composition in accordance with binary diagram "Iron-Nitrogen".

10. The unit according to claim 1, wherein the secondary transducer is made with the capability of computer visualization of diffusion processes with graphic representation of phase composition, nitrogen concentration and microhardness distribution of the diffusion layer in real-time.

* * * * *